US009703247B2

(12) United States Patent
Yamamoto

(10) Patent No.: US 9,703,247 B2
(45) Date of Patent: Jul. 11, 2017

(54) SHEET POST-PROCESSING APPARATUS AND IMAGE FORMING SYSTEM

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Mikio Yamamoto, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/656,857

(22) Filed: Mar. 13, 2015

(65) Prior Publication Data

US 2016/0264372 A1 Sep. 15, 2016

(51) Int. Cl.

| | |
|---|---|
| ***B65H 31/26*** | (2006.01) |
| ***B65H 29/40*** | (2006.01) |
| ***G03G 15/00*** | (2006.01) |
| ***B65H 29/44*** | (2006.01) |
| ***B65H 31/02*** | (2006.01) |
| ***B65H 31/30*** | (2006.01) |

(52) U.S. Cl.

CPC ..... *G03G 15/6538* (2013.01); *B65H 29/40* (2013.01); *B65H 29/44* (2013.01); *B65H 31/02* (2013.01); *B65H 31/26* (2013.01); *B65H 31/3018* (2013.01); *G03G 15/6541* (2013.01); *B65H 2301/4212* (2013.01); *B65H 2301/4213* (2013.01); *B65H 2404/1114* (2013.01); *B65H 2405/11151* (2013.01); *B65H 2405/332* (2013.01); *B65H 2701/1313* (2013.01); *B65H 2801/27* (2013.01); *G03G 2215/00827* (2013.01); *G03G 2215/00848* (2013.01)

(58) Field of Classification Search

CPC ..... B65H 31/26; B65H 31/34; B65H 31/36; B65H 2404/1114; B65H 29/40

See application file for complete search history.

(56) References Cited

U.S. PATENT DOCUMENTS

| | | | |
|---|---|---|---|
| 7,300,045 | B2 | 11/2007 | Terao et al. |
| 7,530,565 | B2 | 5/2009 | Terao et al. |
| 7,748,704 | B2 | 7/2010 | Terao et al. |
| 7,896,333 | B2 | 3/2011 | Taki et al. |

(Continued)

FOREIGN PATENT DOCUMENTS

| | | | |
|---|---|---|---|
| JP | 2001130817 A | * | 5/2001 |
| JP | 2013032197 A | * | 2/2013 |
| JP | 2013052951 A | * | 3/2013 |

*Primary Examiner* — Luis A Gonzalez

(74) *Attorney, Agent, or Firm* — Amin, Turocy & Watson LLP

(57) ABSTRACT

According to one embodiment, a sheet post-processing apparatus includes a supporting member and a plurality of paddles. The supporting member supports the trailing end portion in a conveying direction of a sheet. The plurality of paddles rotates around a rotating shaft independently from the supporting member. The plurality of paddles nip and hold the trailing end portion of the sheet in conjunction with the supporting member from both the sides in the thickness direction of the sheet. The plurality of paddles nip and hold the trailing end portions of the following sheets, which are stacked on the sheet, one by one from the thickness direction of the trailing end portion.

17 Claims, 10 Drawing Sheets

(56) References Cited

U.S. PATENT DOCUMENTS

| | | | | |
|---|---|---|---|---|
| 8,020,857 | B2 | 9/2011 | Terao et al. | |
| 2008/0213017 | A1* | 9/2008 | Morisawa | G03G 15/6538 399/405 |
| 2009/0008872 | A1* | 1/2009 | Ryan | B65H 31/34 271/314 |
| 2014/0291922 | A1* | 10/2014 | Yamamoto | B65H 29/34 271/220 |
| 2014/0300047 | A1 | 10/2014 | Yamamoto et al. | |

* cited by examiner

SHEET POST-PROCESSING APPARATUS AND IMAGE FORMING SYSTEM

FIELD

Embodiments described herein relate generally to a sheet post-processing apparatus and an image forming system.

BACKGROUND

There is a sheet post-processing apparatus that performs post-processing for applying post-processing such as sorting and stapling to a plurality of sheets conveyed from an image forming apparatus. The sheet post-processing apparatus includes a standby tray for putting the sheets on standby and a processing tray for applying the post-processing to the sheets. However, in the standby tray, a jam is likely to be caused by a collision of the sheets put on standby and the sheets conveyed to the standby tray.

DETAILED DESCRIPTION

Figure 1:
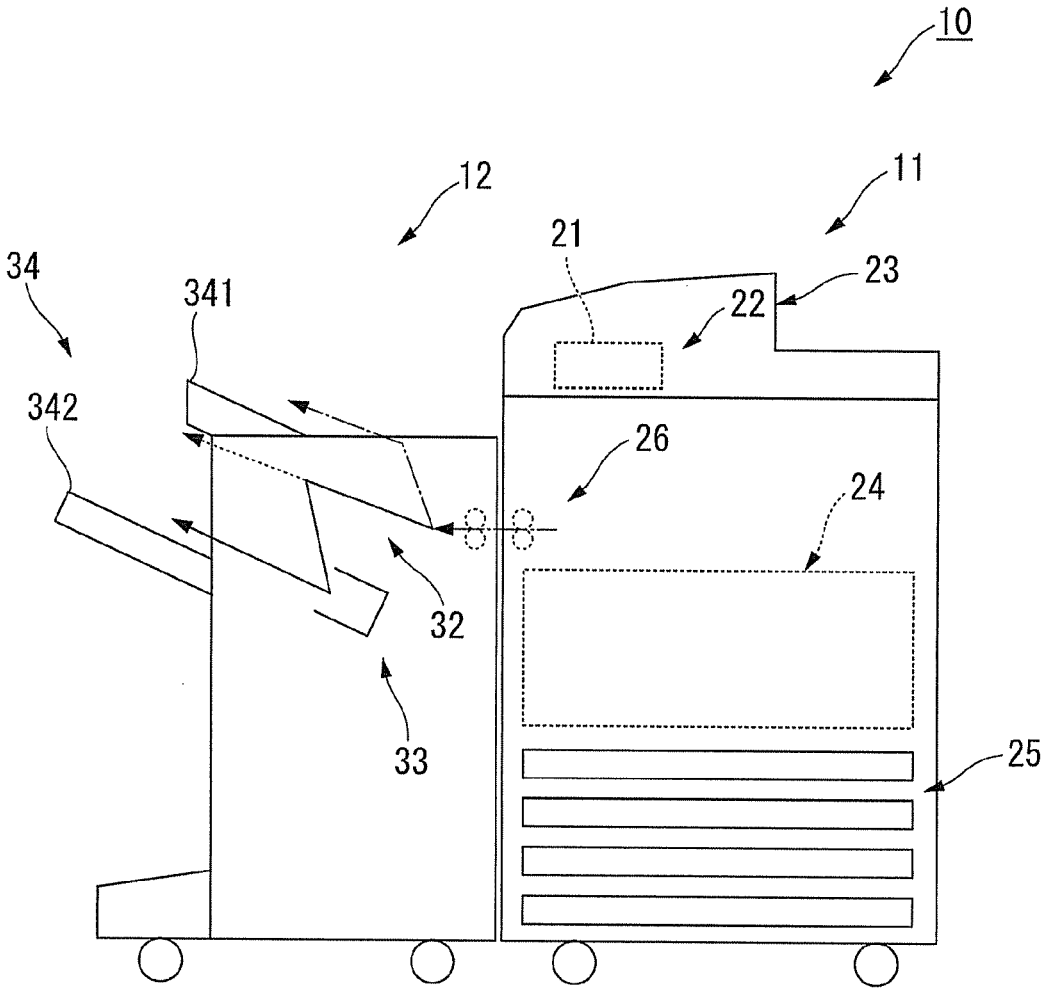
FIG. 1 is a diagram schematically showing an overall configuration example of an image forming apparatus and a sheet post-processing apparatus in an embodiment.

In general, according to one embodiment, a sheet post-processing apparatus includes a supporting member and a plurality of paddles. The supporting member supports the trailing end portion of a sheet in a conveying direction of the sheet. The plurality of paddles rotates around a rotating shaft independently from the supporting member. The plurality of paddles nip and hold the trailing end portion of the sheet in conjunction with the supporting member from both the sides in the thickness direction of the sheet. The plurality of paddles nip and hold the trailing end portions of the following sheets, which are stacked on the sheet, one by one from the thickness direction of the trailing end portion.

An image forming system 10, an image forming apparatus 11, and a sheet post-processing apparatus 12 in an embodiment are explained below with reference to the drawings. Note that, in the figures, the same components are denoted by the same reference numerals and signs.

Figure 2:
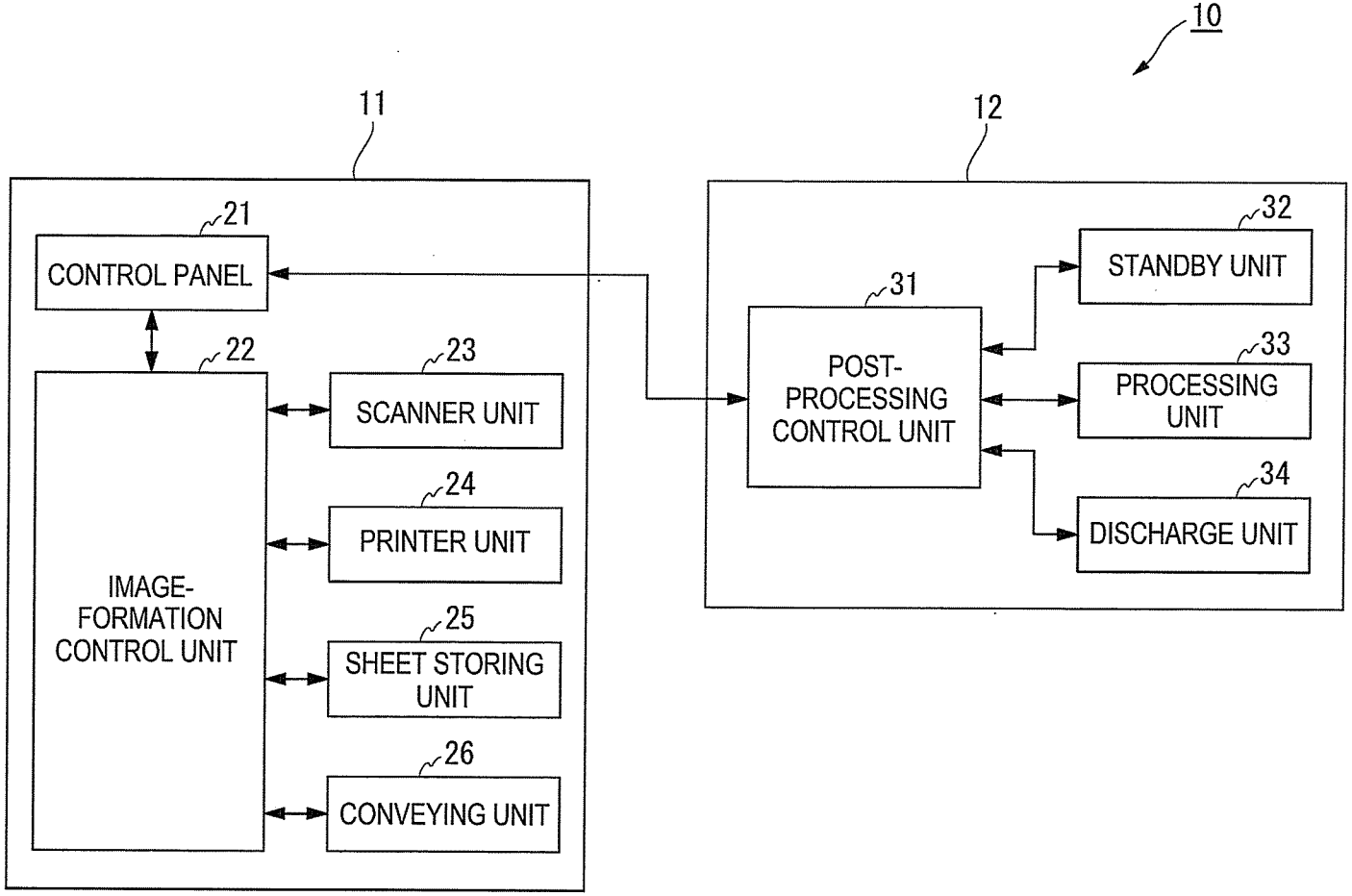
FIG. 2 is a block diagram showing a configuration example of a part of the image forming apparatus and the sheet post-processing apparatus.

FIG. 1 is a diagram schematically showing an overall configuration example of the image forming apparatus 11 and the sheet post-processing apparatus 12 in the embodiment. FIG. 2 is a block diagram of a configuration example of a part of the image forming apparatus 11 and the sheet post-processing apparatus 12 in the embodiment.

As shown in FIGS. 1 and 2, the image forming system 10 includes the image forming apparatus 11 and the sheet post-processing apparatus 12. The image forming apparatus 11 forms images on sheet-like media such as a sheet (hereinafter collectively referred to as "sheet"). The sheet post-processing apparatus 12 executes post-processing to the sheet discharged from the image forming apparatus 11.

The image forming apparatus 11 includes a control panel 21, an image-formation control unit 22, a scanner unit 23, a printer unit 24, a sheet storing unit 25, and a conveying unit 26.

The control panel 21 includes various keys that receive operation from a user. The control panel 21 includes a display unit that performs various kinds of display. The control panel 21 includes a panel control unit including a CPU, a ROM, and a RAM. The panel control unit receives operation on the various keys from the user and controls the display of the display unit. The control panel 21 displays various kinds of information such as the number of prints, the size of the sheet, a type of the sheet, and a type of the post-processing on the display unit. The control panel 21 receives designation and a change of information to be displayed by the display unit. The control panel 21 receives, for example, designation of information indicating a type of the post-processing of the sheet. The control panel 21 outputs the designated information indicating the type of the post-processing of the sheet to the sheet post-processing apparatus 12.

The image-formation control unit 22 controls respective CPUs of the control panel 21, the scanner unit 23, and the printer unit 24. The image-formation control unit 22 controls the operation of the entire image forming apparatus 11. The image-formation control unit 22 includes a CPU, a ROM, and a RAM.

The scanner unit 23 includes a reading unit that reads image information of a copying target object as light and shade of light. The scanner unit 23 includes a scanner control unit including a CPU, a ROM, and a RAM. The scanner control unit controls reading of the image information by the reading unit. The scanner unit 23 outputs the read image information to the printer unit 24.

The printer unit 24 forms an output image with a developer such as toner (hereinafter referred to as toner image) on the basis of image information received from the scanner unit 23 or the outside. The printer unit 24 transfers the toner image onto the surface of the sheet. The printer unit 24 applies heat and pressure to the toner image on the surface of the sheet and fixes the toner image on the sheet. The printer unit 24 includes a printer control unit including a CPU, a ROM, and a RAM. The printer control unit controls printing of an image on the sheet by the printer unit 24.

The sheet storing unit 25 supplies sheets to the printer unit 24 one by one to be timed to coincide with the formation of the toner image by the printer unit 24. The sheet storing unit 25 includes a plurality of paper feeding cassettes. The paper feeding cassettes respectively store sheets of sizes and types set in advance. The paper feeding cassettes respectively include pickup rollers. The pickup rollers extract the sheets from the paper feeding cassettes one by one. The pickup rollers supply the extracted sheets to the conveying unit 26.

The conveying unit 26 conveys the sheet supplied from the sheet storing unit 25 to the printer unit 24. The conveying unit 26 conveys the sheet delivered from the printer unit 24 to the sheet post-processing apparatus 12.

The sheet post-processing apparatus 12 is disposed adjacent to the image forming apparatus 11. The sheet post-processing apparatus 12 executes post-processing designated by the control panel 21 on a plurality of the sheets supplied from the image forming apparatus 11. The sheet post-processing apparatus 12 includes a post-processing control unit 31, a standby unit 32, a processing unit 33, and a discharge unit 34.

The post-processing control unit 31 controls the operation of the entire sheet post-processing apparatus 12. The post-processing control unit 31 includes a CPU, a ROM, and a RAM. During non-sort setting, the post-processing control unit 31 discharges the sheets supplied from the image forming apparatus 11 without sorting out the sheets. During the non-sort setting, the post-processing control unit 31 discharges the sheets to a fixed tray 341 or a movable tray 342 of the discharge unit 34. During the non-sort setting, the post-processing control unit 31 directly discharges the sheets to the fixed tray 341. During the non-sort setting, the post-processing control unit 31 discharges the sheets to the movable tray 342 through the standby unit 32. During sort setting, the post-processing control unit 31 sorts out the sheets supplied from the imaging forming apparatus 11. During staple setting, the post-processing control unit 31 executes stapling on the sheets supplied from the image forming apparatus 11. The post-processing control unit 31 aligns the sheets in the width direction and a conveying direction of the sheets. The post-processing control unit 31 binds the sheets to be aligned together. During the sort setting and the staple setting, the post-processing control unit 31 discharges the sheets to the movable tray 342 through the standby unit 32 and the processing unit 33.

During the non-sort setting, the standby unit 32 discharges the sheets supplied from the image forming apparatus 11 to the movable tray 342. During the sort setting or the stable setting and at predetermined timing, the standby unit 32 puts the sheets supplied from the image forming apparatus 11 on standby. The predetermined timing is, for example, a period in which a first predetermined number of sheets among a plurality of sheets forming a predetermined sheet bundle are supplied from the image forming apparatus 11. The standby unit 32 puts the predetermined number of sheets on standby at the predetermined timing and then discharges the sheets to the processing unit 33. The standby unit 32 discharges the sheets supplied from the image forming apparatus 11 to the processing unit 33 one by one at timing other than the predetermined timing.

The processing unit 33 aligns the sheets. The processing unit 33 binds together the sheets to be aligned. The processing unit 33 discharges the processed sheets to the movable tray 342 of the discharge unit 34.

The discharge unit 34 includes the fixed tray 341 and the movable tray 342. The fixed tray 341 is fixed to an upper part of the sheet post-processing apparatus 12. The movable tray 342 is disposed in a side part of the sheet post-processing apparatus 12. The movable tray 342 is disposed downstream in a conveying direction in each of the standby unit 32 and the processing unit 33. The movable tray 342 moves up and down in the vertical direction of the sheet post-processing apparatus 12.

Figure 3:
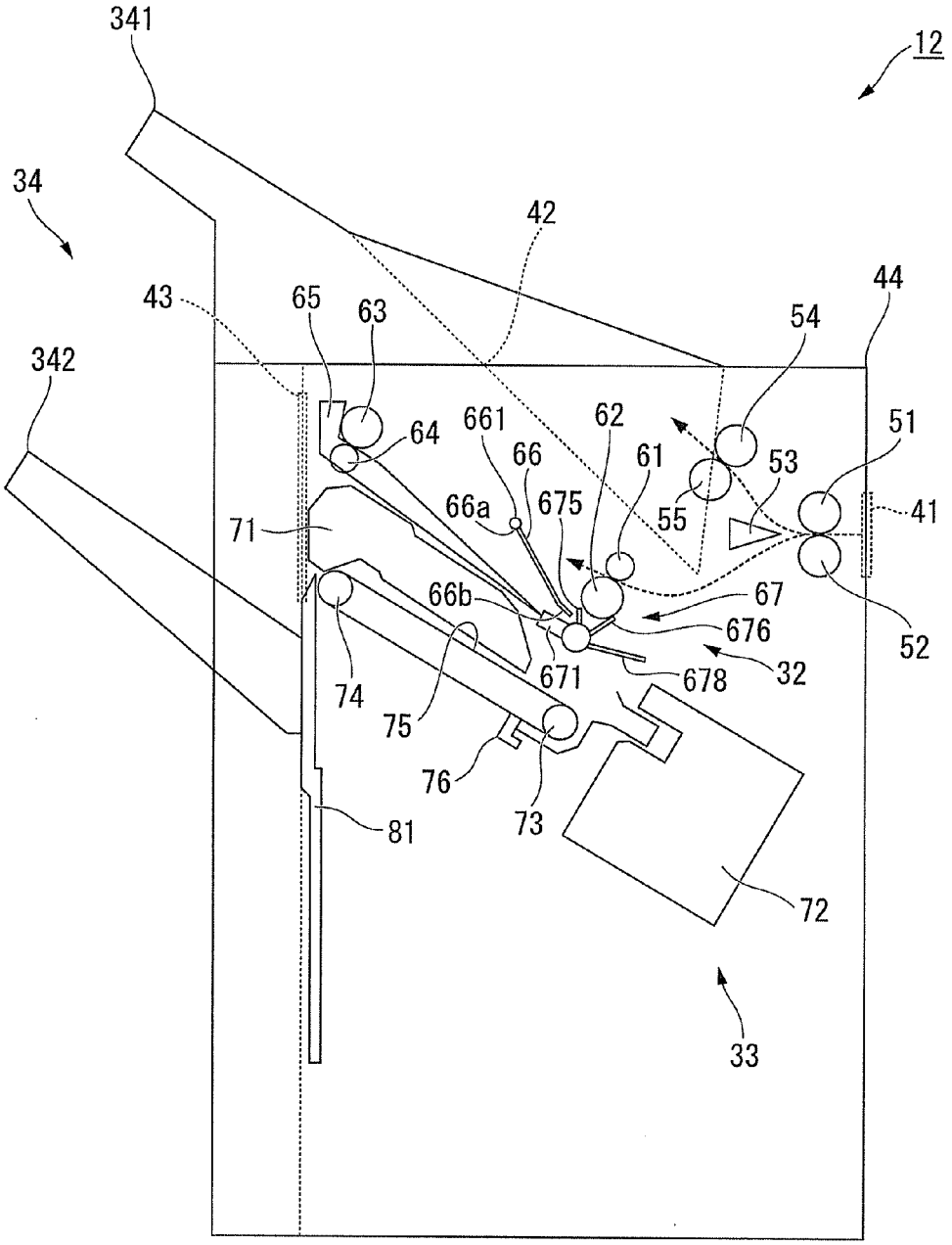
FIG. 3 is a diagram schematically showing a configuration example of a part of the sheet post-processing apparatus.
Figure 4:
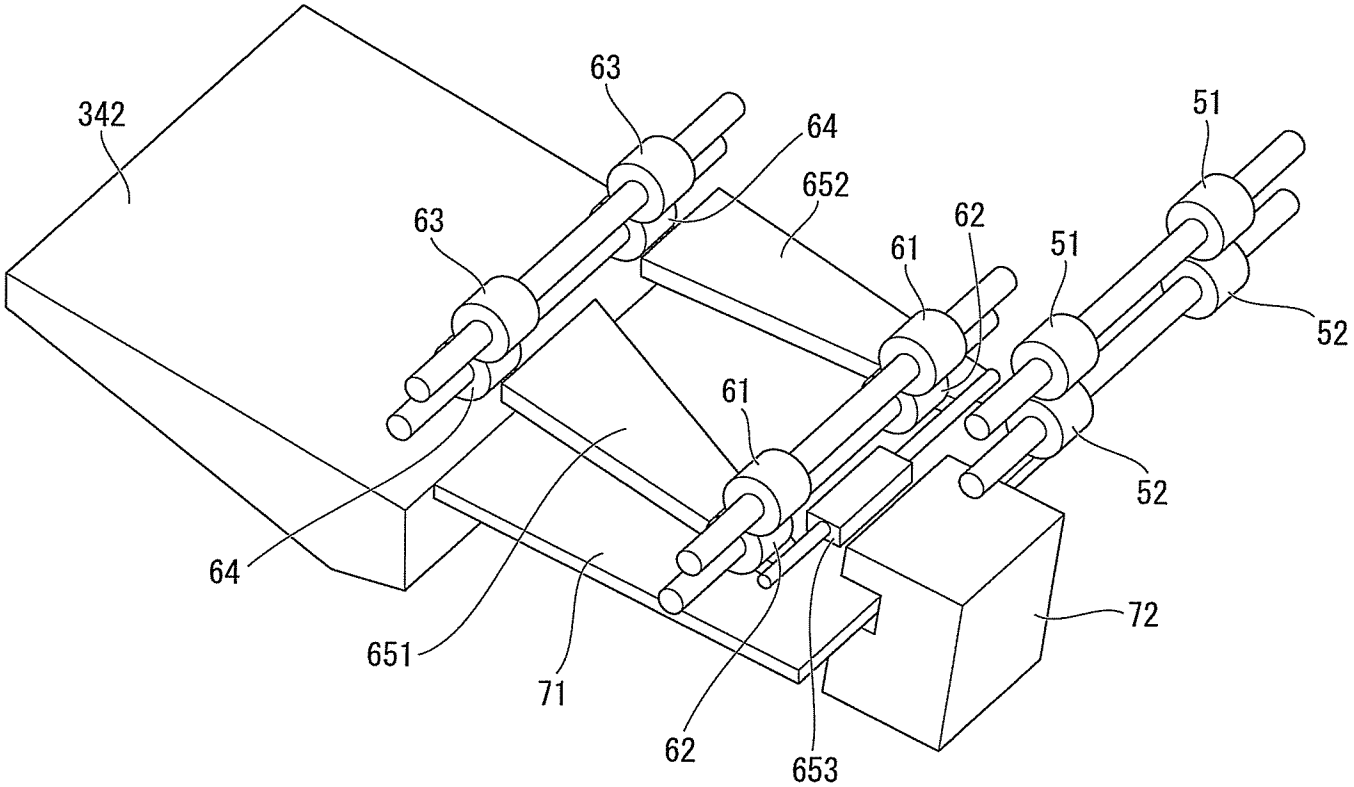
FIG. 4 is a perspective view schematically showing a configuration example of a part of the sheet post-processing apparatus.
Figure 5:
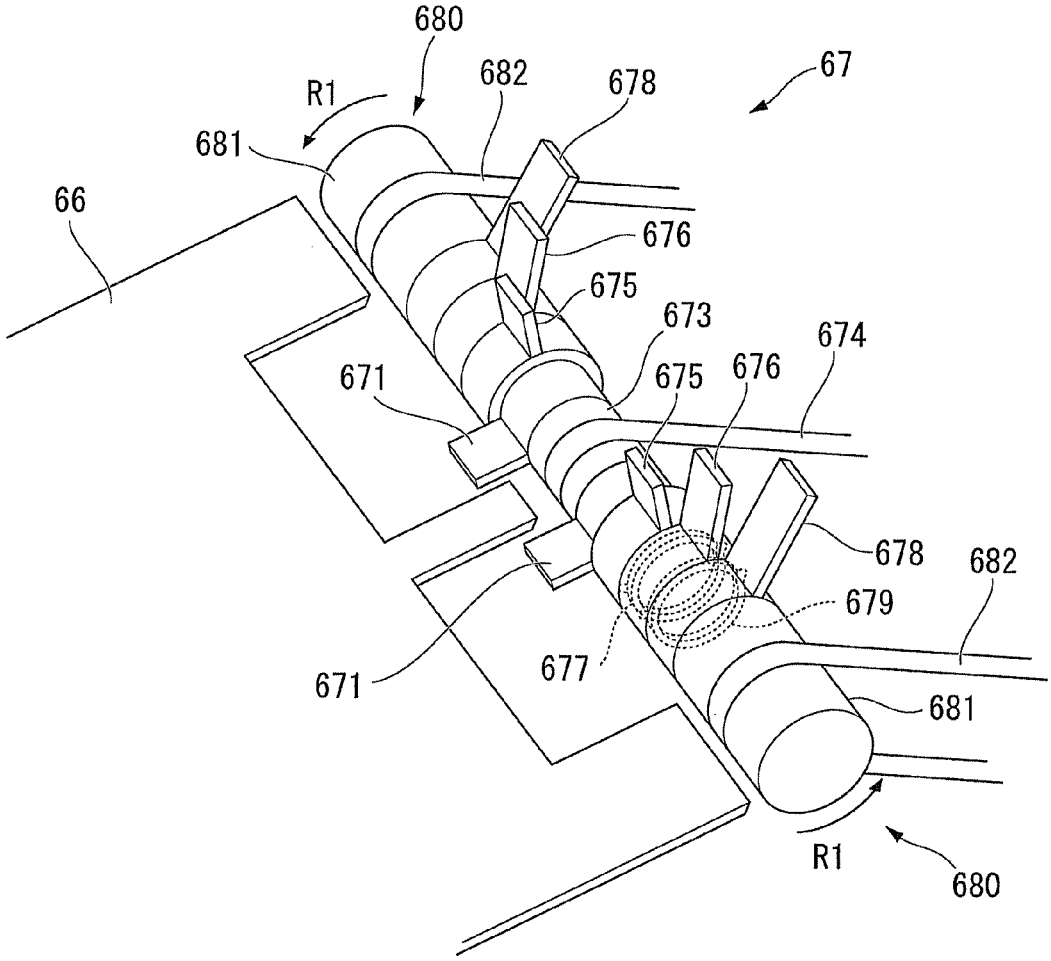
FIG. 5 is a perspective view schematically showing a part of the sheet post-processing apparatus.

The configuration of the sheet post-processing apparatus 12 is explained with reference to FIGS. 3, 4, and 5. FIG. 3 is a diagram schematically showing a configuration example of a part of the sheet post-processing apparatus 12 in the embodiment. FIG. 4 is a perspective view schematically showing a configuration example of a part of the sheet post-processing apparatus 12 in this embodiment. FIG. 5 is a perspective view schematically showing a configuration example of a part of the sheet post-processing apparatus 12 in this embodiment.

The sheet post-processing apparatus 12 includes a housing 44 including a first opening section 41, a second opening section 42, and a third opening section 43 that cause a sheet to pass. The first opening section 41 causes the sheet supplied from the image forming apparatus 11 to pass toward the inside of the sheet post-processing apparatus 12. The second opening section 42 and the third opening section 43 cause the sheet, which is to be discharged, to pass from the inside to the outside of the sheet post-processing apparatus 12.

The sheet post-processing apparatus 12 includes a first inlet roller 51 and a second inlet roller 52, a gate flap 53, and a first paper discharge roller 54 and a second sheet discharge roller 55. The first inlet roller 51 and the second inlet roller 52 constitute an inlet roller pair. One or plural inlet roller pairs may be provided. The first inlet roller 51 and the second inlet roller 52 convey the sheet supplied from the image forming apparatus 11 to the gate flap 53. The first inlet roller 51 and the second inlet roller 52 rotate while nipping the sheet from both the sides in the thickness direction of the sheet. The gate flap 53 switches a conveying direction of the sheet, which is delivered from the first inlet roller 51 and the second inlet roller 52, to the fixed tray 341 or the standby unit 32. The first paper discharge roller 54 and the second paper discharge roller 55 convey the sheet, which is sent to the fixed tray 341 side by the gate flap 53, to the second opening section 42. The first paper discharge roller 54 and the second paper discharge roller 55 rotate while nipping the sheet from both the sides in the thickness direction.

The standby unit 32 includes a first outlet roller 61 and a second outlet roller 62, a first buffer roller 63 and a second buffer roller 64, and a standby tray 65. The first outlet roller 61 and the second outlet roller 32 constitute an outlet roller pair. One or plural outlet roller pairs may be provided. The first buffer roller 63 and the second buffer roller 64 constitute a buffer roller pair. One or plural buffer roller pairs may be provided.

The first outlet roller 61 and the second outlet roller 62 convey the sheet, which is sent from the gate flap 53 to the standby unit 32 side, to the first buffer roller 63 and the second buffer roller 64. The first outlet roller 61 and the second outlet roller 62 rotate while nipping the sheet from both the sides in the thickness direction.

During the non-sort setting, the first buffer roller 63 and the second buffer roller 64 convey the sheet to the third opening section 43. During the non-sort setting, the first buffer roller 63 and the second buffer roller 64 rotate in a direction in which the sheet is delivered downstream in the conveying direction while nipping the sheet from both the sides in the thickness direction. During the sort setting and the staple setting, the first buffer roller 63 and the second buffer roller 64 rotate in a direction in which the sheet is delivered upstream in the conveying direction. During the sort setting and the staple setting, the first buffer roller 63 and the second buffer roller 64 rotate until the trailing end portion of the sheet is supported by a trailing-end supporting unit 67. During the sort setting and the staple setting, the first buffer roller 63 and the second buffer roller 64 release the nipping of the sheet when the sheet is supplied to the processing unit 33.

The standby tray 65 includes a first tray member 651 and a second tray member 652 and a tray driving unit 653. The first tray member 651 and the second tray member 652 are disposed a predetermined space apart from each other in the width direction of the sheet in the standby unit 32. The width direction of the sheet in the standby unit 32 is a direction orthogonal to the conveying direction of the sheet in the standby unit 32. The first tray member 651 and the second tray member 652 are inclined with respect to the horizontal direction to set the downstream side in the conveying direction of the sheet in the standby unit 32 higher than the upstream side. The first tray member 651 and the second tray member 652 hold the sheet delivered from the first outlet roller 61 and the second outlet roller 62. The first tray member 651 and the second tray member 652 stack a plurality of the sheets in the thickness direction and holds the sheets. The tray driving unit 653 moves the first tray member 651 and the second tray member 652 in opposite directions each other in the width direction of the sheet in synchronization with each other. The tray driving unit 653 includes a gear mechanism such as a rack pinion mechanism and a motor. When the sheet is discharged from the standby unit 32 to the processing unit 33, the tray driving unit 653 moves the first tray member 651 and the second tray member 652 in directions in which the first tray member 651 and the second tray member 652 move away from each other.

The standby unit 32 includes an assist arm 66 and the trailing-end supporting unit 67. Note that the standby unit 32 does not need to include the assist arm 66, the trailing-end supporting section 67, and the like and only has to include the standby tray 65.

The assist arm 66 presses the trailing end portion of the uppermost sheet in a stacking direction of the sheets placed on the standby tray 65 toward the trailing-end supporting unit 67. The assist arm 66 rotates around a rotating shaft 661 provided above the standby tray 65. The axial direction of the rotating shaft 661 is a direction parallel to the width direction of the sheet in the standby unit 32. The assist arm 66 includes a proximal end portion 66*a* fixed to the rotating shaft 661 and a distal end portion 66*b* disposed upstream in the conveying direction of the sheet in the standby unit 32 from the rotating shaft 661. The distal end portion 66*b* of the assist arm 66 is formed in a comb teeth shape. The shape of the distal end portion 66*b* of the assist arm 66 is a shape not interfering with rotation tracks of a pedestal 671, a first paddle 675, a second paddle 676, and a third paddle 678 explained below. The distal end portion 66*b* of the assist arm 66 allows the rotation of the pedestal 671, the first paddle 675, the second paddle 676, and the third paddle 678 while pressing the trailing end portion of the uppermost sheet.

The trailing-end supporting unit 67 is disposed upstream of the standby tray 65 in the conveying direction of the standby unit 32 and below the standby tray 65 in the vertical direction. The trailing-end supporting unit 67 includes the pedestal 671 and a pedestal driving unit 672. The pedestal 671 is fixed to a pedestal driving shaft 673. The axial direction of the pedestal driving shaft 673 is a direction parallel to the width direction of the sheet in the standby unit 32. The pedestal 671 projects outward in the radial direction from the outer circumferential surface of the pedestal driving shaft 673. The pedestal 671 is formed in a flat shape. The pedestal 671 supports the trailing end portion in the conveying direction of the sheet placed on the standby tray 65. The pedestal driving unit 672 includes a driving belt 674 wound on the outer circumferential surface of the pedestal driving shaft 673 and a motor that drives to rotate the driving belt 674. The driving belt 674 rotates the pedestal driving shaft 673 with a driving force output by the motor. When the pedestal 671 rotates in a first rotating direction R1 while supporting the trailing end portion of the sheet, the pedestal 671 drops the trailing end portion of the sheet.

The trailing-end supporting section 67 includes the first paddle 675, the second paddle 676, first driving members 677, the third paddle 678, second driving members 679, and a paddle driving unit 680. Each of the first paddle 675, the second paddle 676, and the third paddle 678 is provided in a paddle driving shaft 681. The paddle driving shaft 681 is disposed coaxially with the pedestal driving shaft 673. The paddle driving shaft 681 rotates independently from the pedestal driving shaft 673. Each of the first paddle 675, the second paddle 676, and the third paddle 678 projects outward in the radial direction from the outer circumferential surface of the paddle driving shaft 681. Each of the first paddle 675, the second paddle 676, and the third paddle 678 is formed in a flat shape having predetermined thickness. Each of the first paddle 675, the second paddle 676, and the third paddle 678 is formed of an elastic material such as a rubber material. The projection length of the first paddle 675 is set smaller than the projection length of the pedestal 671. The projection length of the second paddle 676 is set larger than the projection length of the first paddle 675. The projection length of the third paddle 678 is set larger than the projection length of the second paddle 676. The projection length of the third paddle 678 is set larger than the distance from the outer circumferential surface of the paddle driving shaft 681 to a processing tray 71 explained below.

In the axial direction of the pedestal driving shaft 673 and the paddle driving shaft 681, the pedestal 671 is disposed further on the center side in the width direction of the sheet than the first paddle 675. In the axial direction of the pedestal driving shaft 673 and the paddle driving shaft 681, the first paddle 675 is disposed further on the end side in the width direction of the sheet than the pedestal 671. In the axial direction of the pedestal driving shaft 673 and the paddle driving shaft 681, the second paddle 676 is disposed further on the end side in the width direction of the sheet than the first paddle 675. The third paddle 678 is disposed further on the end sides in the width direction of the sheet than the second paddle 676. The first paddle 675 is disposed behind the pedestal 671 in the first rotating direction R1 of the pedestal 671. The second paddle 676 is disposed behind the first paddle 675 in the first rotating direction R1 of the pedestal 671. The third paddle 678 is disposed behind the second paddle 676 in the first rotating direction R1 of the pedestal 671.

The first paddle 675 and the second paddle 676 rotate around the paddle driving shaft 681. The first paddle 675 and the second paddle 676 are connected by the first driving members 677. The first driving members 677 are elastic members such as torsion springs. The first driving members 677 apply an elastic force between the first paddle 675 and the second paddle 676 in the circumferential direction of the paddle driving shaft 681. The third paddle 678 is fixed to the paddle driving shaft 681. The second paddle 676 and the third paddle 678 are connected by the second driving members 679. The second driving members 679 are elastic members such as torsion springs. The second driving members 679 apply an elastic force between the second paddle 676 and the third paddle 678 in the circumferential direction of the paddle driving shaft 681. The paddle driving unit 680 includes paddle driving belts 682 wound on the outer circumferential surface of the paddle driving shaft 681 and a motor that drives to rotate the paddle driving belts 682. The paddle driving belts 682 rotate the paddle driving shaft 681 with a driving force output by the motor. The paddle driving shaft 681 and the third paddle 678 rotates with the driving force transmitted via the paddle driving belts 682. When rotating in the first rotating direction R1, the third paddle 678 transmits the driving force to the second paddle 676 via the second driving members 679 while approaching the second paddle 676. When rotating in the first rotating direction R1, the second paddle 676 transmit the driving force to the first paddle 675 via the first driving members 677 while approaching the first paddle 675. When rotating in the first rotating direction R1, the first paddle 675 approaches the pedestal 671 that stands still.

The pedestal 671 and the first paddle 675 nip and hold, from both the sides in the thickness direction, the trailing end portion of the lowermost sheet in the stacking direction of the sheets placed on the standby tray 65. The first paddle 675 and the second paddle 676 nip and hold, from both sides in the thickness direction, the trailing end portion of the second sheet stacked on the lowermost sheet (the first sheet). The second paddle 676 and the third paddle 678 nip and hold, from both sides in the thickness direction, the trailing end portion of the third sheet stacked on the second sheet.

When rotating to incline downward, the pedestal 671, the first paddle 675, the second paddle 676, and the third paddle 678 drop the held sheet onto the processing tray 71. When coming into contact with the sheet while rotating in the first rotating direction R1, the first paddle 675, the second paddle 676, and the third paddle 678 rake the sheet upstream in the conveying direction of the processing unit 33.

The processing unit 33 includes the processing tray 71, a stapler 72, a first conveying roller 73, a second conveying roller 74, a conveyor belt 75, and a bundle discharge guide 76.

The processing tray 71 is disposed below the standby tray 65. The processing tray 71 is inclined with respect to the horizontal direction to set the downstream side in the conveying direction of the sheet in the processing unit 33 higher than the upstream side. A plurality of the sheets stacked on the processing tray 71 are aligned in the width direction and the conveying direction of the sheet by alignment plates or the like.

The stapler 72 is disposed upstream of the processing tray 71 in the conveying direction of the sheet. The stapler 72 executes stapling (binding) to a bundle of a predetermined number of the sheets stacked on the processing tray 71.

The first conveying roller 73 and the second conveying roller 74 are disposed a predetermined space apart from each other in the conveying direction of the sheet in the processing unit 33. The first conveying roller 73 is disposed on the upstream side in the conveying direction of the sheet. The second conveying roller 74 is disposed on the downstream side in the conveying direction of the sheet. The first conveying roller 73 is disposed in a position in the vertical direction relatively lower than the second conveying roller 74.

The conveyor belt 75 is laid over the first conveying roller 73 and the second conveying roller 74. The conveyor belt 75 rotates in synchronization with the first conveying roller 73 and the second conveying roller 74. The conveyor belt 75 conveys the sheet between the stapler 72 and the discharge unit 34.

The bundle discharge guide 76 is provided in the conveyor belt 75. The bundle discharge guide 76 is formed in a claw shape projecting from the surface of the conveyor belt 75. The bundle discharge guide 76 comes into contact with the trailing end portion of a bundle of sheets placed on the conveyor belt 75. The bundle discharge guide 76 conveys the bundle of sheets on the conveyor belt 75 toward the discharge unit 34 according to the rotation of the conveyor belt 75.

The fixed tray 341 of the discharge unit 34 accumulates the sheets discharged from the second opening section 42 of the housing 44. The movable tray 342 of the discharge unit 34 accumulates the sheets discharged from the third opening section 43 of the housing 44. The third opening section 43 is provided on the downstream side in the conveying direction of each of the standby unit 32 and the processing unit 33. The discharge unit 34 includes a shutter 81 that moves up and down with respect to the third opening section 43. The shutter 81 moves up in order to close a part of the third opening section 43 during the non-sort setting. The shutter 81 moves up to thereby prevent the front end portion in the conveying direction of the processing tray 71 from being exposed to the outside from the third opening section 43. The shutter 81 moves down in order to open the entire third opening section 43 during the sort setting and staple setting. The shutter 81 moves down to thereby expose the front end portion in the conveying direction of the processing tray 71 to the outside from the third opening section 43.

Figure 6:
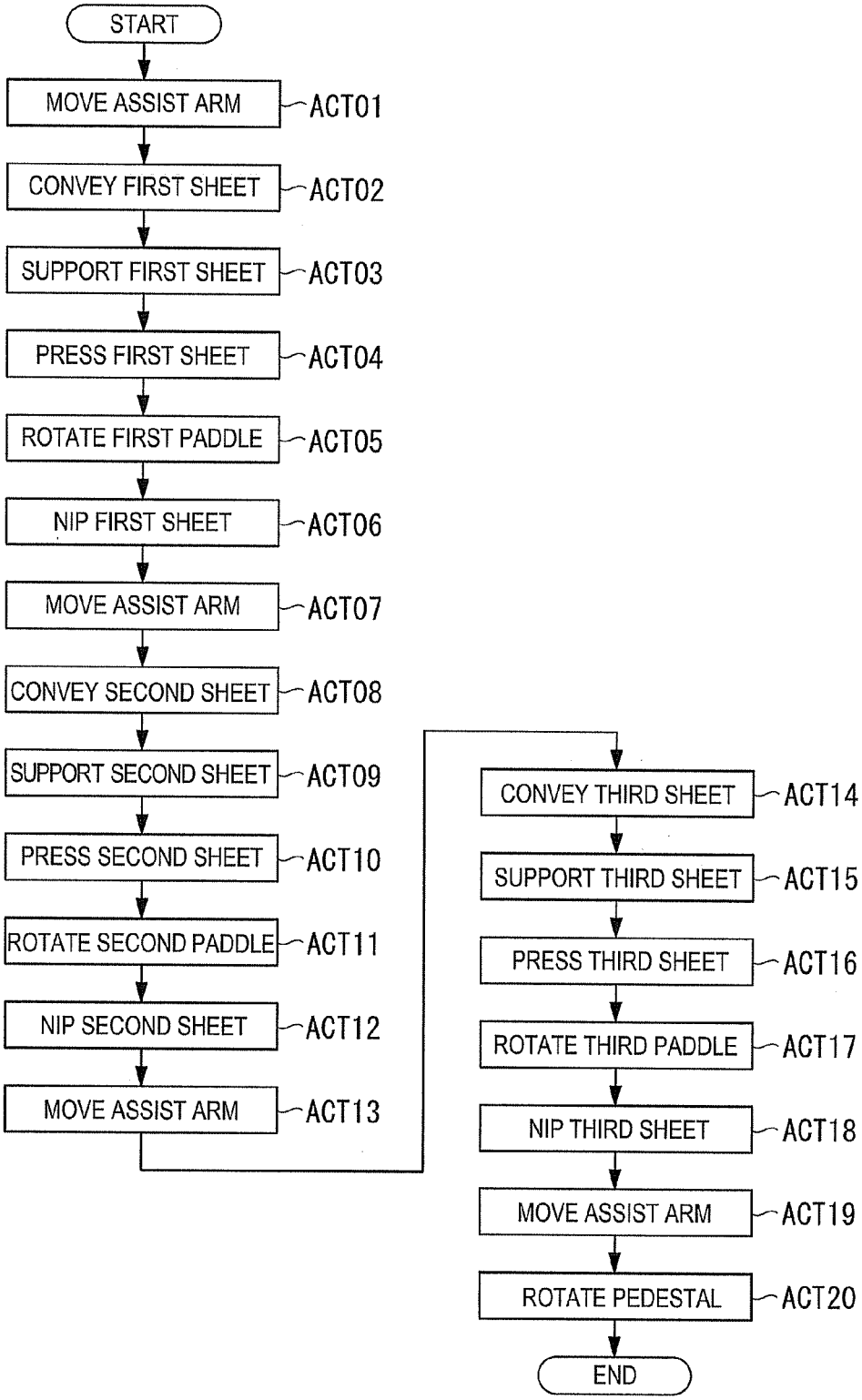
FIG. 6 is a flowchart for explaining an operation example of the sheet post-processing apparatus.
Figure 7:
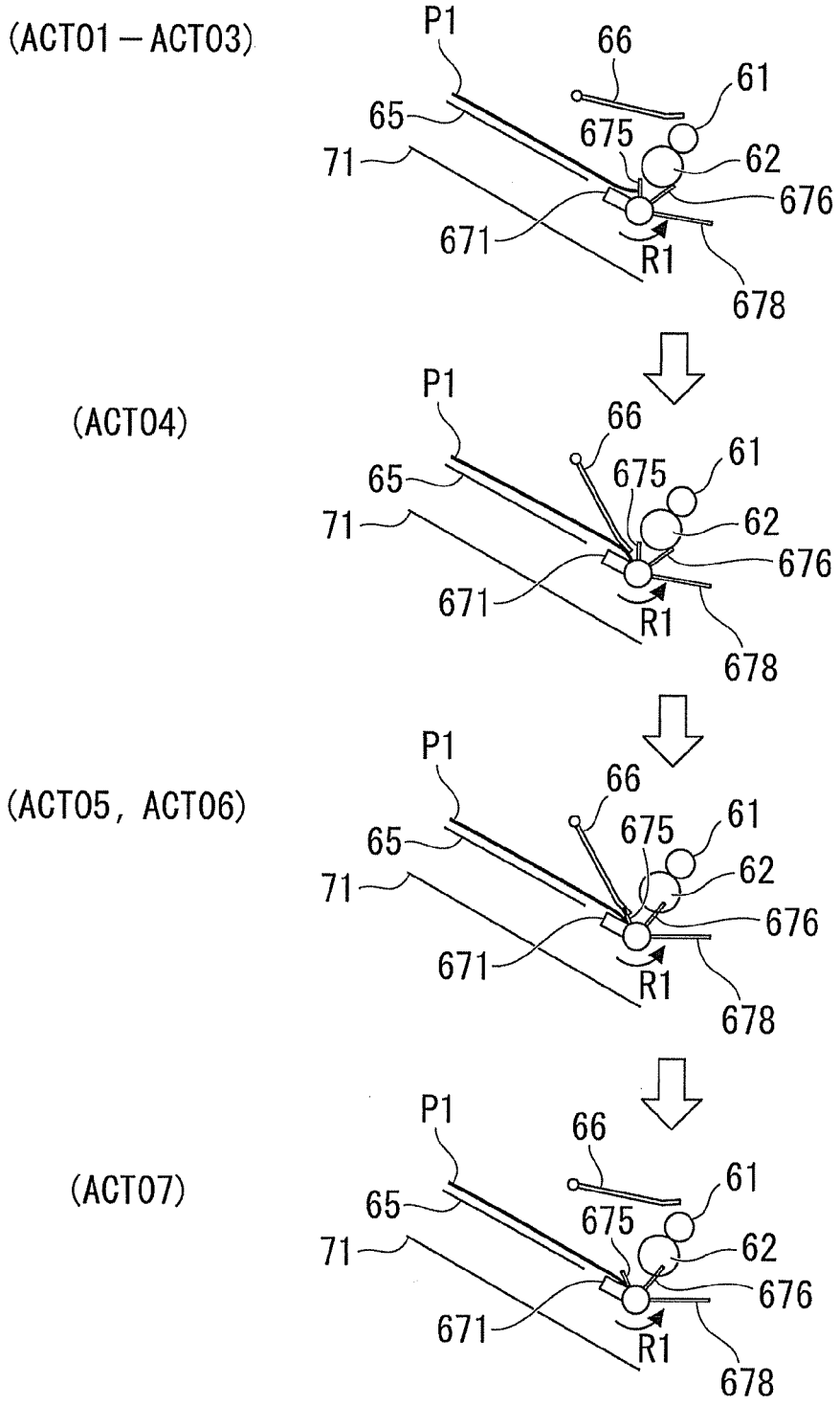
FIG. 7 is a diagram schematically showing an operation example of a part of the sheet post-processing apparatus.
Figure 8:
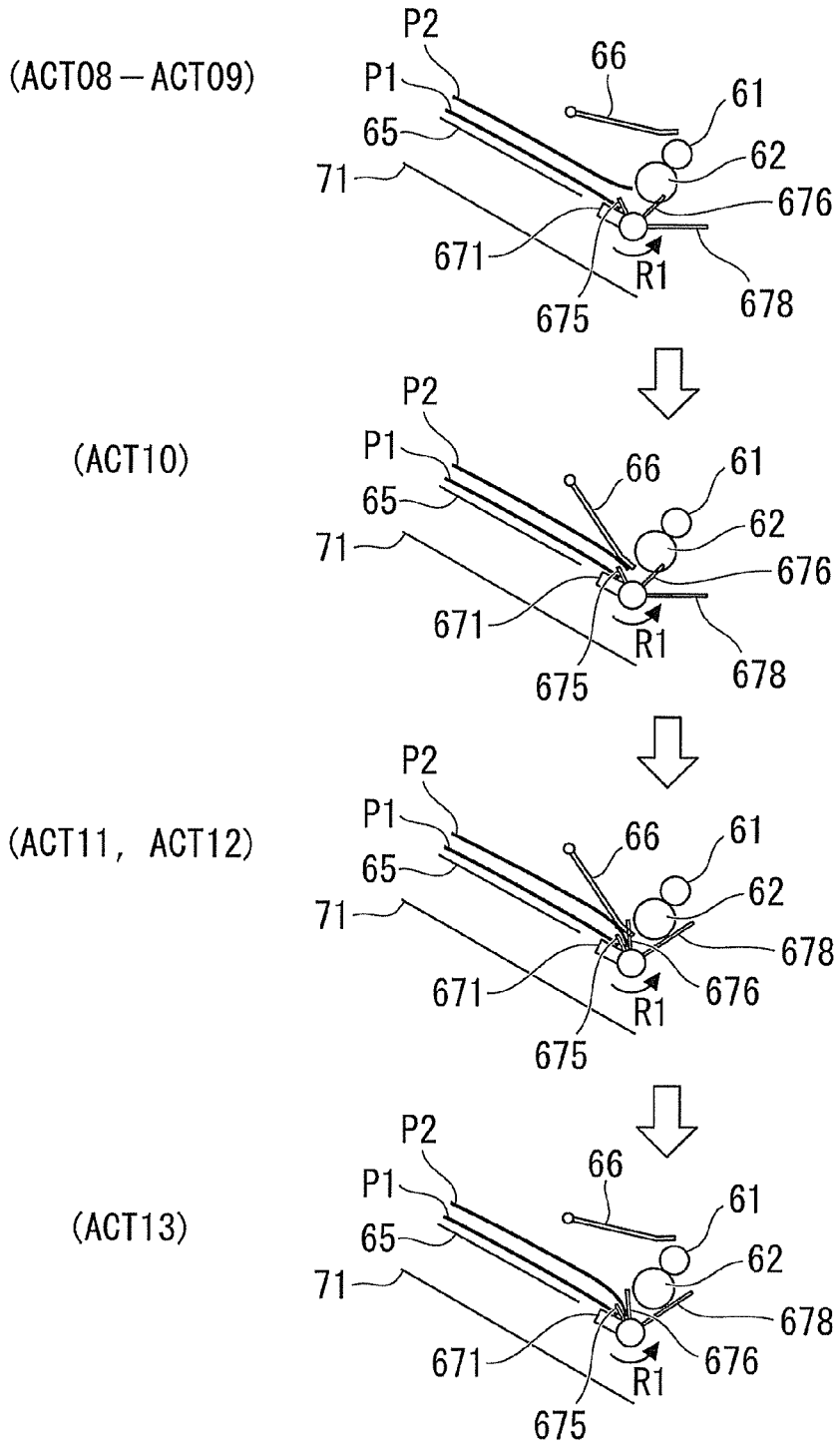
FIG. 8 is a diagram schematically showing an operation example of a part of the sheet post-processing apparatus.
Figure 9:
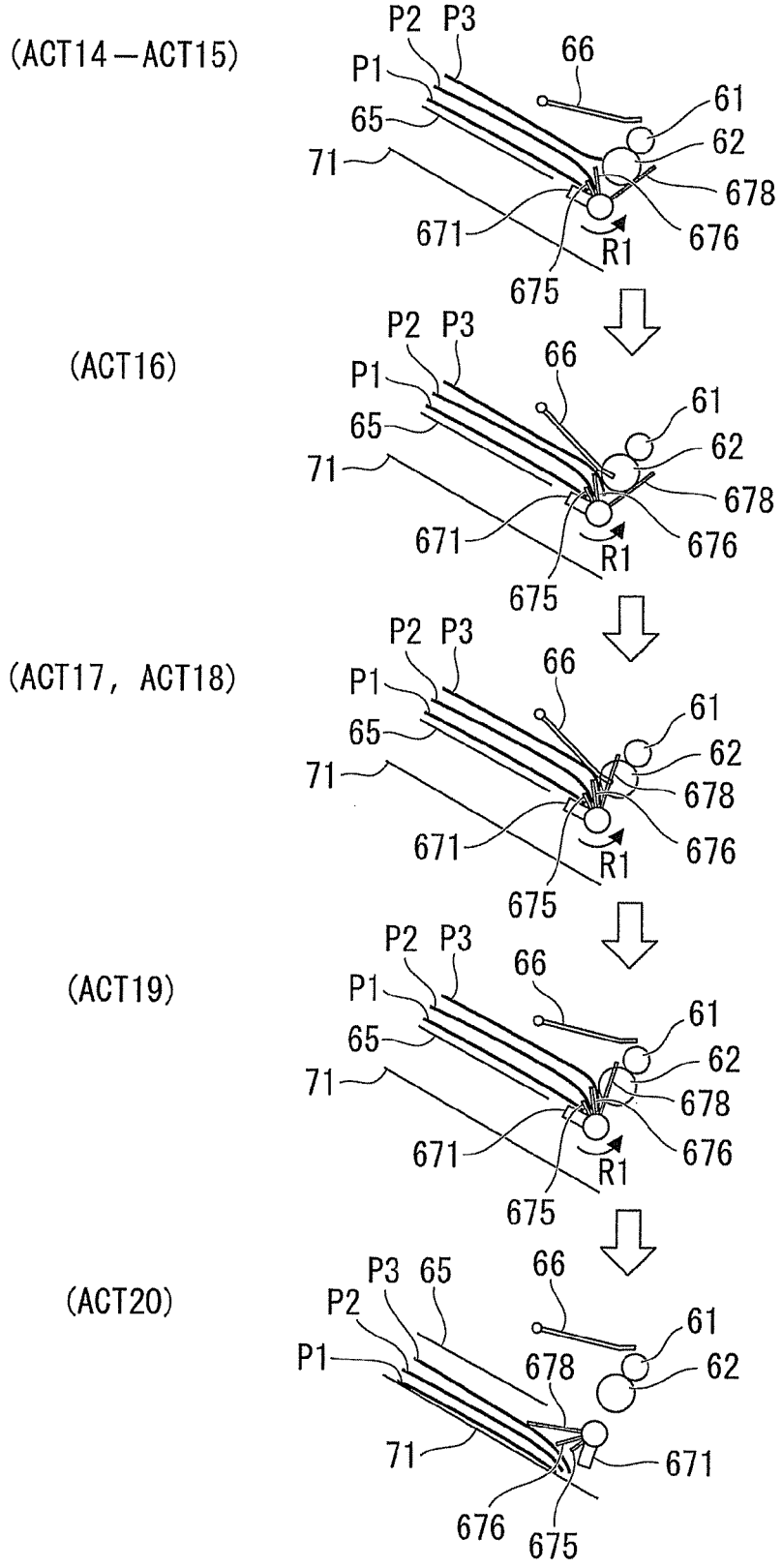
FIG. 9 is a diagram schematically showing an operation example of a part of the sheet post-processing apparatus.

The operation of the sheet post-processing apparatus 12 is explained below with reference to FIGS. 6, 7, 8, and 9. FIG. 6 is a flowchart for explaining an operation example of the sheet post-processing apparatus 12 in the embodiment. FIGS. 7, 8, and 9 are diagrams schematically showing operation examples of the sheet post-processing apparatus 12 in the embodiment.

First, the post-processing control unit 31 moves the assist arm 66 to a reference position before a first sheet is conveyed to the standby tray 65 (ACT 01). The reference position of the assist arm 66 is a position where the sheet conveyed from the first outlet roller 61 and the second outlet roller 62 and the assist arm 66 do not interfere with each other.

Subsequently, the post-processing control unit 31 conveys a first sheet P1 to the standby tray 65 with the first outlet roller 61 and the second outlet roller 62 (ACT 02).

The post-processing control unit 31 supports the trailing end portion of the first sheet 21 with the pedestal 671 that is in a rotation stop state (ACT 03).

The post-processing control unit 31 presses the trailing end portion of the first sheet P1 toward the pedestal 671 with the assist arm 66 (ACT 04).

The post-processing control unit 31 actuates the paddle driving unit 680 while pressing the first sheet P1 toward the pedestal 671 with the assist arm 66. The post-processing control unit 31 applies a driving force for rotation in the first rotating direction R1 from the paddle driving unit 680 to the first paddle 675, the second paddle 676, and the third paddle 678. The post-processing control unit 31 rotates the first paddle 675 in the first rotating direction R1 until the first paddle 675 presses the first sheet P1 toward the pedestal 671 (ACT 05).

The post-processing control unit 31 nips and holds the trailing end portion of the first sheet P1 from both the sides in the thickness direction with the pedestal 671 and the first paddle 675 (ACT 06).

The post-processing control unit 31 moves the assist arm 66 to the reference position before a second sheet is conveyed to the standby tray 65 (ACT 07).

The post-processing control unit 31 conveys a second sheet P2 to the standby tray 65 with the first outlet roller 61 and the second outlet roller 62 (ACT 08).

The post-processing control unit 31 supports the trailing end portion of the second sheet P2 with the first paddle 675 that is in the rotation stop state (ACT 09).

The post-processing control unit 31 presses the trailing end portion of the second sheet P2 toward the first paddle 675 with the assist arm 66 (ACT 10).

The post-processing control unit 31 actuates the paddle driving unit 680 while pressing the second sheet P2 toward the first paddle 675 with the assist arm 66. The post-processing control unit 31 applies a driving force for rotation in the first rotating direction R1 from the paddle driving unit 680 to the second paddle 676 and the third paddle 678. The post-processing control unit 31 rotates the second paddle 676 until the second paddle 676 presses the second sheet P2 toward the first paddle 675 (ACT 11).

The post-processing control unit 31 nips and holds the trailing end portion of the second sheet P2 from both sides in the thickness direction with the first paddle 675 and the second paddle 676 (ACT 12).

The post-processing control unit 31 moves the assist arm 66 to the reference position before a sheet supplied third (a third sheet) is conveyed to the standby tray 65 (ACT 13).

The post-processing control unit 31 conveys the third sheet P3 to the standby tray 65 with the first outlet roller 61 and the second outlet roller 62 (ACT 14).

The post-processing control unit 31 supports the trailing end portion of the third sheet P2 with the second paddle 676 that is in the rotation stop state (ACT 15).

The post-processing control unit 31 presses the trailing end portion of the third sheet P3 toward the second paddle 676 with the assist arm 66 (ACT 16).

The post-processing control unit 31 actuates the paddle driving unit 680 while pressing the third sheet P3 toward the second paddle 676 with the assist arm 66. The post-processing control unit 31 applies a driving force for rotation in the first rotating direction R1 from the paddle driving unit 680 to the third paddle 678. The post-processing control unit 31 rotates the third paddle 678 until the third paddle 678 presses the third sheet P3 toward the second paddle 676 (ACT 17).

The post-processing control unit 31 nips and holds the trailing end portion of the third sheet P3 from both sides in the thickness direction with the second paddle 676 and the third paddle 678 (ACT 18).

The post-processing control unit 31 moves the assist arm 66 to the reference position (ACT 19).

The post-processing control unit 31 actuates the pedestal driving unit 672 and the paddle driving unit 680. The post-processing control unit 31 simultaneously rotates the pedestal 671, the first paddle 675, the second paddle 676, and the third paddle 678 in the first rotating direction R1. The post-processing control unit 31 drops the first sheet P1, the second sheet P2, and the third sheet P3 onto the processing tray 71 (ACT 20). The post-processing control unit 31 ends the processing.

The sheet post-processing apparatus 12 in the embodiment explained above includes the trailing-end supporting unit 67 that nips and holds the trailing end portion of each of the stacked sheets. Therefore, it is possible to prevent occurrence of a jam. The sheet post-processing apparatus 12 includes the pedestal 671 and the first paddle 675 that nip the trailing end portion of the first sheet P1 before the second sheet P2 is conveyed to the standby tray 65. Therefore, it is possible to prevent occurrence of a jam. The sheet post-processing apparatus 12 includes the first paddle 675 and the second paddle 676 that nip the trailing end portion of the second sheet P2 before the third sheet P3 is conveyed to the standby tray 65. Therefore, it is possible to prevent occurrence of a jam.

The sheet post-processing apparatus 12 includes the second driving members 679 that transmit a driving force from the third paddle 678 to the second paddle 676. Therefore, compared with when the second paddle 676 includes a driving source, it is possible to simplify the configuration of the sheet post-processing apparatus 12. The sheet post-processing apparatus 12 includes the first driving members 677 that transmit a driving force from the second paddle 676 to the first paddle 675. Therefore, compared with when the first paddle 675 includes driving sources, it is possible to simplify the configuration of the sheet post-processing apparatus 12.

The sheet post-processing apparatus 12 includes the first paddle 675, the second paddle 676, and the third paddle 678, the projecting lengths of which increase in this order. Therefore, it is possible to suppress alignment disorder in the conveying direction of the sheet of the processing tray 71. The sheet post-processing apparatus 12 includes the second paddle 676 having the projection length larger than the projection length of the first paddle 675. Therefore, even if the raking by the first paddle 675 is insufficient, the sheet can be appropriately raked in by the second paddle 676. The sheet post-processing apparatus 12 includes the third paddle 678 having the projection length larger than the projection length of the second paddle 676. Therefore, even if the raking by the second paddle 676 is insufficient, the sheet can be appropriately raked in by the third paddle 678.

The sheet post-processing apparatus 12 includes the first paddle 675, the second paddle 676, and the third paddle 678 disposed further on the end portion side in the width direction of the sheet than the pedestal 671. Therefore, it is possible to appropriately hold the sheet. The sheet post-processing apparatus 12 includes the second paddle 676 having the projection length larger than the projection length of the first paddle 675 and disposed further on the end portion side of the sheet than the first paddle 675. Therefore, it is also possible to appropriately hold a curled sheet. The sheet post-processing apparatus 12 includes the third paddle 678 having the projection length larger than the projection length of the second paddle 676 and disposed on the end portion side of the sheet than the second paddle 676. Therefore, it is also possible to appropriately hold a curled sheet.

The sheet post-processing apparatus 12 includes the assist arm 66 that presses the trailing end portion of the uppermost sheet in the stacked sheets toward the pedestal 671. Therefore, it is possible to prevent occurrence of a jam.

The sheet post-processing apparatus 12 includes the assist arm 66 that does not interfere with the rotation tracks of the first paddle 675, the second paddle 676, and the third paddle 678. Therefore, it is possible to appropriately hold the sheets one by one. The sheet post-processing apparatus 12 includes the assist arm 66 that does not interfere with the first paddle 675. Therefore, it is possible to bring the first paddle 675 into contact with the first sheet while pressing the first sheet against the pedestal 671. The sheet post-processing apparatus 12 includes the assist arm 66 that does not interfere with the second paddle 676. Therefore, it is possible to bring the second paddle 676 into contact with the second sheet while pressing the second sheet against the first paddle 675. The sheet post-processing apparatus 12 includes the assist arm 66 that does not interfere with the third paddle 678. Therefore, it is possible to bring the third paddle 678 into contact with the third sheet while pressing the third sheet against the second paddle 676.

The sheet post-processing apparatus 12 includes the assist arm 66 including the distal end portion 66*b* disposed on the trailing end portion side of the uppermost sheet in the stacked sheets. Therefore, it is possible to appropriately press the trailing end portion of the sheet.

A modification of the embodiment is explained below.

Figure 10:
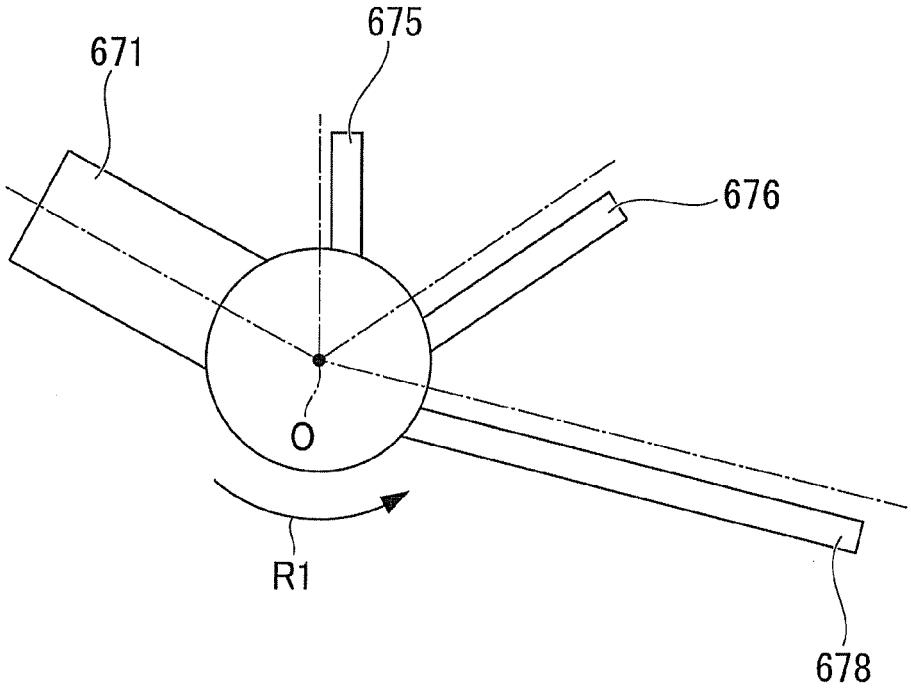
FIG. 10 is a diagram schematically showing a configuration example of a trailing-end supporting unit in a sheet post-processing apparatus in a modification of the embodiment.

In the embodiment explained above, the first paddle 675, the second paddle 676, and the third paddle 678 are explained as projecting in the radial direction of the paddle driving shaft 681. However, the sheet post-processing apparatus 12 is not limited to this. In the following explanation, a modification of the sheet post-processing apparatus 12 in the embodiment is explained with reference to FIG. 10. FIG. 10 is a diagram schematically showing a configuration example of the trailing-end supporting unit 67 in the modification of the sheet post-processing apparatus 12 in the embodiment.

At least any one of the first paddle 675, the second paddle 676, and the third paddle 678 may be provided to be offset from a rotation center O of the paddle driving shaft 681. The first paddle 675, the second paddle 676, and the third paddle 678 may be provided to be offset backward in the first rotating direction R1 from the rotation center O of the paddle driving shaft 681.

According to this modification, it is easy to rake in the sheet, which is stacked on the processing tray 71, upstream in the conveying direction of the processing unit 33.

Figure 11:
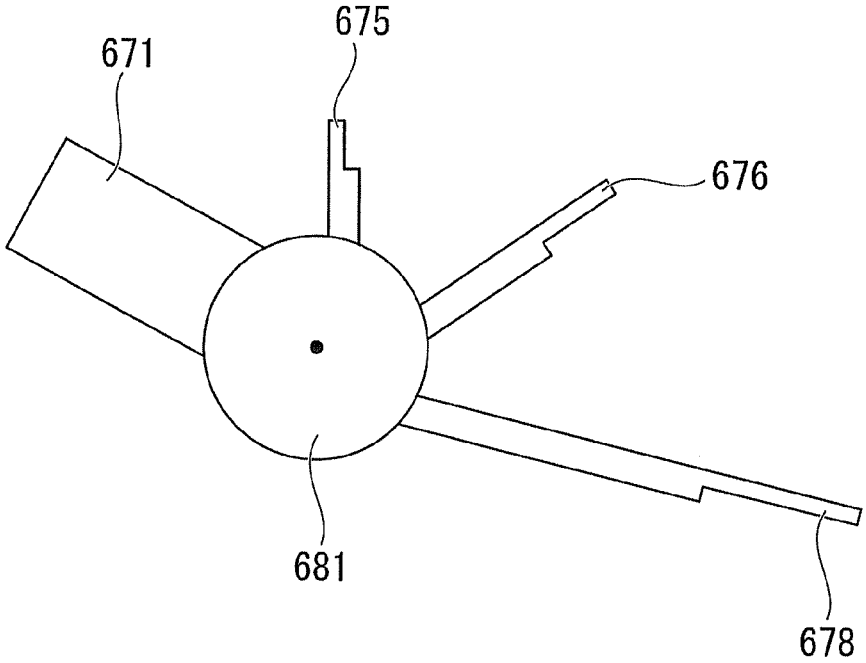
FIG. 11 is a diagram schematically showing a configuration example of a trailing-end supporting unit in a sheet post-processing apparatus in a modification of the embodiment.

In the embodiment, each of the first paddle 675, the second paddle 676, and the third paddle 678 is explained as being formed in the flat shape having the predetermined thickness. However, the sheet post-processing apparatus 12 is not limited to this. In the following explanation, a modification of the sheet post-processing apparatus 12 in the embodiment is explained with reference to FIG. 11. FIG. 11 is a diagram schematically showing a configuration example of the trailing-end supporting unit 67 in the modification of the sheet post-processing apparatus 12 in the embodiment.

The thickness of at least any one of the first paddle 675, the second paddle 676, and the third paddle 678 may change to decrease from the paddle driving shaft 681 toward the distal ends of the paddles. The thickness of the distal end portion of each of the first paddle 675, the second paddle 676, and the third paddle 678 may be set smaller than the thickness of the proximal end portion.

According to this modification, it is possible to reduce the loudness of sound that occurs when each of the first paddle 675, the second paddle 676, and the third paddle 678 comes into contact with the sheet.

In the embodiment explained above, the rotating shaft 661 of the assist arm 66 is explained as being provided above the standby tray 65. However, the rotating shaft 661 of the assist arm 66 is not limited to this.

In the embodiment, the assist arm 66 is explained as including the distal end portion 66*b* upstream in the conveying direction of the sheet from the rotating shaft 661 to the standby unit 32. However, the assist arm 66 is not limited to this.

The rotating shaft 661 of the assist arm 66 may be coaxial with the rotation axis of the first outlet roller 61 and the second outlet roller 62. The assist arm 66 may include the distal end portion 66*b* downstream in the conveying direction of the sheet from the rotating shaft 661 to the standby unit 32.

In the embodiment explained above, the trailing-end supporting unit 67 is explained as including the second driving members 679 that transmit a driving force from the third paddle 678 and the second paddle 676. However, the trailing-end supporting unit 67 is not limited to this.

The trailing-end supporting unit 67 may include a driving source that drives to rotate the second paddle 676 independently from the paddle driving unit 680.

In the embodiment, the trailing-end supporting unit 67 is explained as including the first driving members 677 that transmit a driving force from the second paddle 676 to the first paddle 675. However, the trailing-end supporting unit 67 is not limited to this.

The trailing-end supporting unit 67 may include a driving source that drives to rotate the first paddle 675 independently from the paddle driving unit 680.

In the embodiment, the trailing-end supporting unit 67 is explained as including the three paddles, i.e., the first paddle 675, the second paddle 676, and the third paddle 678. However, the trailing-end supporting unit 67 is not limited to this.

The trailing-end supporting unit 67 may include two paddles, i.e., the first paddle 675 and the second paddle 676 or may include four or more paddles.

In the embodiment explained above, the trailing-end supporting unit 67 is explained as including the first paddle 675, the second paddle 676, and the third paddle 678, the projection lengths of which increase in this order. However, the trailing-end supporting unit 67 is not limited to this.

The trailing-end supporting unit 67 may include at least the second paddle 676 and the third paddle 678 having the projection lengths larger than the projection length of the first paddle 675.

The trailing-end supporting unit 67 may include the first paddle 675, the second paddle 676, and the third paddle 678 having the same projection length.

According to at least one embodiment explained above, the sheet post-processing apparatus 12 includes the trailing-end supporting unit 67 that nips and holds the trailing end portion of each of the stacked sheets. Therefore, it is possible to prevent occurrence of a jam.

The sheet post-processing apparatus 12 includes the plurality of paddles disposed on the end portion side in the width direction of the sheet than the pedestal 671. Therefore, it is possible to appropriately hold even a curled sheet.

The sheet post-processing apparatus 12 includes the assist arm 66 that presses the uppermost sheet in the stacked sheet toward the pedestal 671. Therefore, it is possible to suppress occurrence of a jam.

The sheet post-processing apparatus 12 includes the assist arm 66 that does not interfere with the rotation tracks of the plurality of paddles. Therefore, it is possible to appropriately hold the sheets one by one.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet post-processing apparatus comprising:

a supporting member configured to support a trailing end portion in a conveying direction of a sheet;

a plurality of paddles configured to rotate around a rotating shaft independently from the supporting member, nip and hold the trailing end portion of the sheet in conjunction with the supporting member from both sides in a thickness direction of the sheet, and nip and hold trailing end portions of following sheets, which are stacked on the sheet, one by one from the thickness direction of the trailing end portion, in the plurality of paddles, a length from the rotating shaft to a distal end of a paddle on a far side from the supporting member in a rotating direction being relatively larger than a length from the rotating shaft to a distal end of a paddle on a near side from the supporting member in the rotating direction; and a driving member configured to drive to rotate paddles other than the most backward paddle among the plurality of paddles according to rotation of the most backward paddle.

2. The apparatus according to claim 1, further comprising an arm member configured to press a trailing end portion of an uppermost sheet in a stacking direction of the sheet and the at least one sheet toward the supporting member.

3. The apparatus according to claim 2, wherein the arm member is formed in a comb teeth shape that does not interfere with rotation tracks of the plurality of paddles while pressing the trailing end portion of the sheet toward the supporting member.

4. The apparatus according to claim 2, wherein the arm member includes:

a proximal end portion fixed to an arm rotating shaft disposed further on a downstream side in the conveying direction than the trailing end portion of the uppermost sheet; and a distal end portion disposed on the trailing end portion side of the uppermost sheet, and the arm member rotates around the arm rotating shaft to press, with the distal end portion, the trailing end portion of the uppermost sheet toward the supporting member.

5. The apparatus according to claim 1, wherein each of the plurality of paddles is provided to be offset from a rotation center of the rotating shaft.

6. An image forming system comprising:

the sheet post-processing apparatus according to claim 1;

an image forming unit configured to form an image on a sheet; and a conveying unit configured to convey the sheet having the image formed thereon to the sheet post-processing apparatus.

7. A sheet post-processing apparatus comprising:

a supporting member configured to support a trailing end portion in a conveying direction of a sheet;

a plurality of paddles configured to rotate around a rotating shaft independently from the supporting member, nip and hold the trailing end portion of the sheet in conjunction with the supporting member from both sides in a thickness direction of the sheet, and nip and hold trailing end portions of following sheets, which are stacked on the sheet, one by one from the thickness direction of the trailing end portion, the plurality of paddles being disposed relatively further on an end portion side of the sheet than the supporting member in the axial direction of the rotating shaft; and a driving member configured to drive to rotate paddles other than the most backward paddle among the plurality of paddles according to rotation of the most backward paddle.

8. The apparatus according to claim 7, further comprising an arm member configured to press a trailing end portion of an uppermost sheet in a stacking direction of the sheet and the at least one sheet toward the supporting member.

9. The apparatus according to claim 8, wherein the arm member is formed in a comb teeth shape that does not interfere with rotation tracks of the plurality of paddles while pressing the trailing end portion of the sheet toward the supporting member.

10. The apparatus according to claim 8, wherein the arm member includes:

a proximal end portion fixed to an arm rotating shaft disposed further on a downstream side in the conveying direction than the trailing end portion of the uppermost sheet; and a distal end portion disposed on the trailing end portion side of the uppermost sheet, and the arm member rotates around the arm rotating shaft to press, with the distal end portion, the trailing end portion of the uppermost sheet toward the supporting member.

11. The apparatus according to claim 7, wherein each of the plurality of paddles is provided to be offset from a rotation center of the rotating shaft.

12. An image forming system comprising:

the sheet post-processing apparatus according to claim 7;

an image forming unit configured to form an image on a sheet; and a conveying unit configured to convey the sheet having the image formed thereon to the sheet post-processing apparatus.

13. A sheet post-processing apparatus comprising:

a supporting member configured to support a trailing end portion in a conveying direction of a sheet;

a plurality of paddles configured to rotate around a rotating shaft independently from the supporting member, nip and hold the trailing end portion of the sheet in conjunction with the supporting member from both sides in a thickness direction of the sheet, and nip and hold trailing end portions of following sheets, which are stacked on the sheet, one by one from the thickness direction of the trailing end portion, a thickness in a rotating direction of each of the plurality of paddles changing to decrease toward a distal end of the paddle from the rotating shaft; and a driving member configured to drive to rotate paddles other than the most backward paddle among the plurality of paddles according to rotation of the most backward paddle.

14. The apparatus according to claim 13, further comprising an arm member configured to press a trailing end portion of an uppermost sheet in a stacking direction of the sheet and the at least one sheet toward the supporting member.

15. The apparatus according to claim 14, wherein the arm member includes:

a proximal end portion fixed to an arm rotating shaft disposed further on a downstream side in the conveying direction than the trailing end portion of the uppermost sheet; and a distal end portion disposed on the trailing end portion side of the uppermost sheet, and the arm member rotates around the arm rotating shaft to press, with the distal end portion, the trailing end portion of the uppermost sheet toward the supporting member.

16. The apparatus according to claim 13, wherein each of the plurality of paddles is provided to be offset from a rotation center of the rotating shaft.

17. An image forming system comprising:

the sheet post-processing apparatus according to claim 13;

an image forming unit configured to form an image on a sheet; and a conveying unit configured to convey the sheet having the image formed thereon to the sheet post-processing apparatus.

* * * * *